United States Patent [19]

Feisst

[11] Patent Number: 4,805,356

[45] Date of Patent: Feb. 21, 1989

[54] COLLAPSIBLE BUILDING

[76] Inventor: Kenneth W. Feisst, 150 Victoria St., Cambridge, New Zealand

[21] Appl. No.: 168,868

[22] Filed: Mar. 4, 1988

[30] Foreign Application Priority Data

Mar. 4, 1987 [NZ] New Zealand ..... 219486

[51] Int. Cl.[4] ..... E04B 1/346

[52] U.S. Cl. ..... 52/71; 52/79.4; 52/143; 220/6

[58] Field of Search ..... 52/71, 143, 79.4, 64, 52/646; 220/4 F, 6

[56] References Cited

U.S. PATENT DOCUMENTS

| | | | |
|---|---|---|---|
| 1,506,627 | 8/1924 | Francis et al. | 220/6 |
| 3,189,949 | 6/1965 | Hurkamp | 52/71 X |
| 4,036,361 | 7/1977 | Jacobson et al. | 220/6 X |
| 4,653,238 | 3/1987 | Berman | 52/79.4 |

FOREIGN PATENT DOCUMENTS

| | | | |
|---|---|---|---|
| 152741 | 8/1983 | Australia | 52/143 |
| 97476 | 2/1964 | Denmark | 52/64 |
| 1232626 | 10/1960 | France | 52/79.4 |

*Primary Examiner*—Carl D. Friedman
*Assistant Examiner*—Jerrold D. Johnson

[57] ABSTRACT

A collapsible building comprises first, second, third and fourth panels which in use form a floor, a roof and side walls of the building being pivotally connected so as to be able to be folded down to lie parallel to each other, and fifth and sixth end panels. The end panels are each pivotally attached to both the first and second panels and also have a pivotal joint so that an outer face of each panel may be collapsed onto itself in accordian fashion. Each end panel has a substantially circular rim to allow the erected building to be rolled into location. Stabilizers are provided to stabilize the building once in position.

10 Claims, 2 Drawing Sheets

SEC. A-A

COLLAPSIBLE BUILDING

BACKGROUND OF THE INVENTION

This invention relates to a collapsible building which can be erected from its folded state and then easily manoeuvered onto its final site.

In countries that have experienced some natural disaster or where a high density of population exist, there is often a need for housing which can be cheaply and quickly put in place. Collapsible buildings are well known. They are compact for storage and transport, and are readily installed using local skills and equipment.

BRIEF SUMMARY OF THE INVENTION

The present invention consists in a collapsible building which is substantially box shaped having a stabilizing means, a substantially rectangular first panel and a second panel opposite the first panel, opposite substantially rectangular third and fourth panels both of which are pivoted to the first or second panels so that they can lie substantially parallel to at least one of them when the building is collapsed and substantially normal to at least one of them when the building is erected, and opposite fifth and sixth panels which are substantially normal to at least one of the first and second panels and to the third and fourth panels and are pivotally attached to both the first and second panels, the fifth and sixth panels also having a pivotal joint so that an outer face of each panel may be collapsed onto itself in accordian fashion, each fifth and sixth panel being provided with a substantially circular rim, the construction and arrangement being such that the building when erected can be rolled into location on the rims and stabilized by means of the stabilizing means when it is in its chosen position.

BRIEF DESCRIPTION OF THE DRAWINGS

The above gives a broad description of the present invention, one preferred form of which will now be described with reference to the accompanying drawings in which.

DETAILED DESCRIPTION OF THE PREFERRED EMBODIMENT

Figure 1:
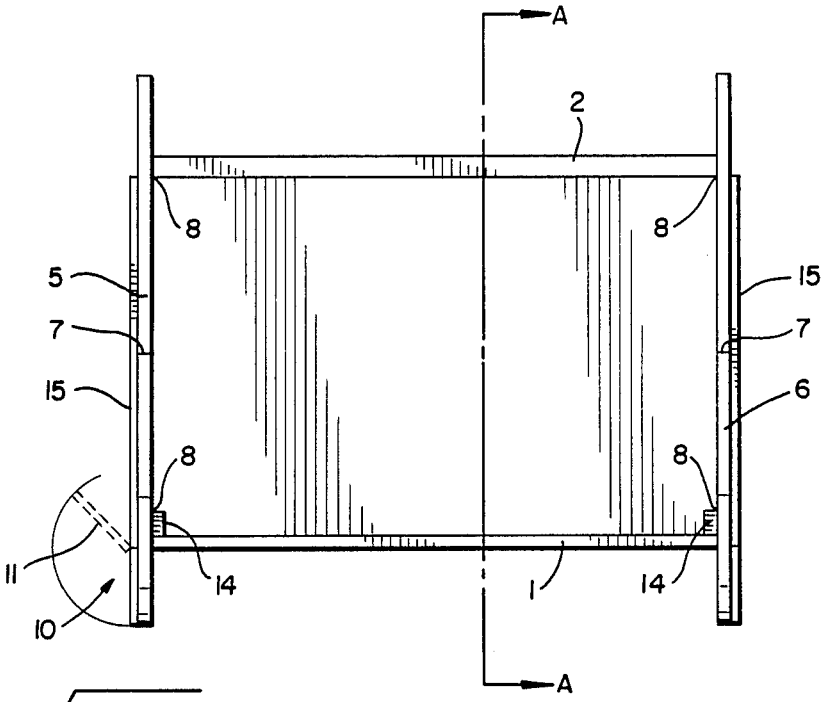
FIG. 1 is a side elevation of the preferred form of collapsible building.
Figure 2:
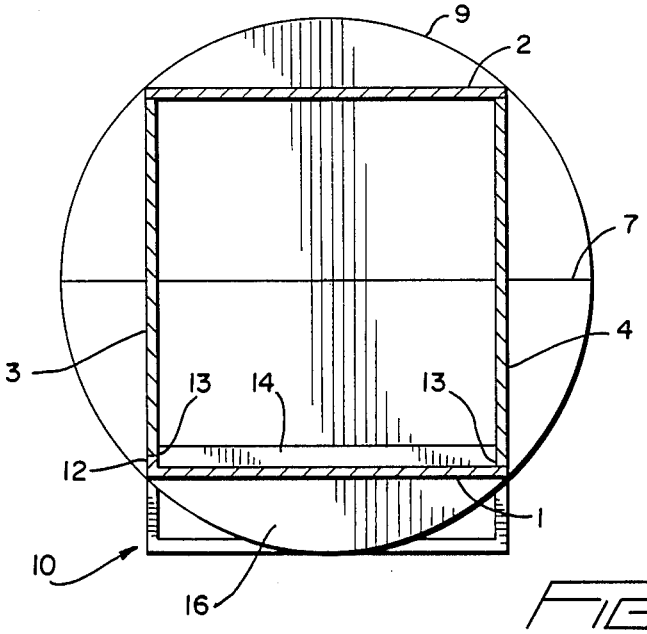
FIG. 2 is a cross-section of the collapsible building.

In the preferred form of the invention as shown in FIGS. 1 and 2 the collapsible building is substantially box shaped having a substantially rectangular first panel 1 which is opposite a second panel 2. Substantially rectangular and opposite third panel 3 and fourth panel 4 can be pivoted either to the first panel 1 or second panel 2 so that they can lie substantially parallel to them when the building is collapsed and substantially normal to them when the building is erected. The ends of the building comprise a fifth panel 5 opposite to a sixth panel 6 being substantially normal to the other panels 1, 2, 3 and 4 and are pivotally attached to both first panel 1 and second panel 2 at pivot points 8.

Figure 3:
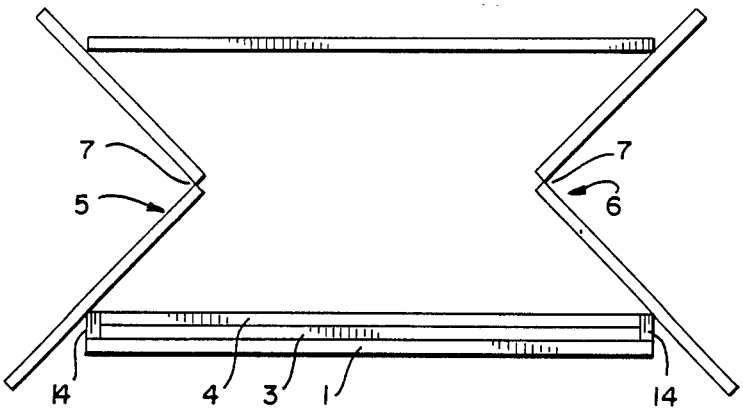
FIG. 3 is a side elevation of the collapsible building in a semi-collapsed position and, FIG. 4 is an end elevation of an alternative embodiment of the collapsible building.

Fifth panel 5 and sixth panel 6 also have a pivotal joint 7 which as seen in FIG. 3 allows an outer face of each panel to be collapsed onto itself in accordian fashion. As seen in FIG. 2 a rim 9 of fifth panel 5 and sixth panel 6 is substantially circular. Stabilizing means 10 is provided to stabilize the building once it is placed in position.

Figure 5:
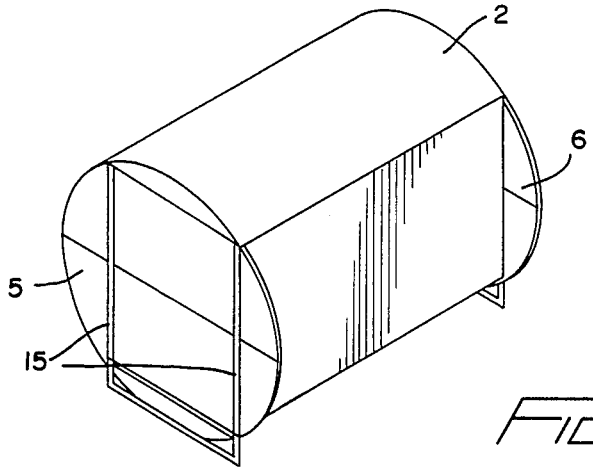
FIG. 5 is a schematic drawing of the preferred form of collapsible building.

In the preferred form of the invention the second panel 2 is substantially rectangular and parallel to the first panel 1. Alternatively the second panel 2 could be rounded in shape as illustrated in FIG. 5 so as to form a roof of the building.

Referring to FIG. 2, third panel 3 and fourth panel 4 form side walls and are pivotally attached at pivot points 13 to first panel 1 which forms the floor of the building. A nib 12 is provided to allow third panel 3 to fold down parallel to fourth panel 4 which when collapsing the building is folded down before third panel 3. Similarly as shown in FIG. 1, a nib 14 is provided at either end of first panel 1 to raise the pivot points 8 which attach fifth panel 5 and sixth panel 6 to first panel 1 so that each of these panels can lie parallel to the other panels when the building is in a collapsed state.

Figure 4:
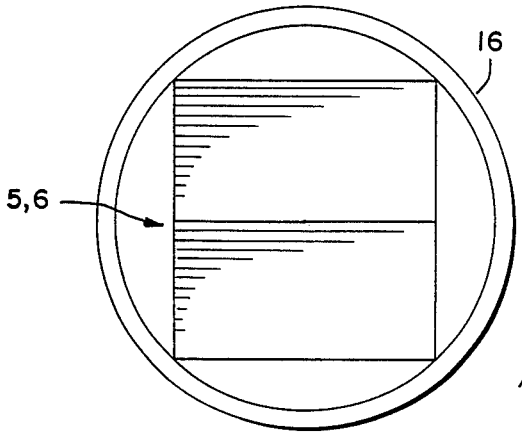

In the illustrated embodiment fifth panel 5 and sixth panel 6 have two semi-circular halves pivotally attached about pivotal joint 7 and when erected their outer edge provides a substantially circular rim 9. The circular shape of fifth panel 5 and sixth panel 6 allows the building to be manoeuvered into position once it has been erected. Other shapes may achieve this purpose for example hexagonal, or octagonal or other multi-sided panels. Alternatively as shown in FIG. 4, fifth panel 5 and sixth panel 6 may comprise pivotally attached halves which form a square to which is attached an exterior circular ring 16. The circular ring is attached at each corner of the square.

Once the building is positioned it is stabilized by stabilizing means 10 which comprise two substantially rectangular frames 11 each pivotally attached on fifth panel 5 and sixth panel 6. Each frame 11 is swung down and locked in position to prevent the building rolling on the rim 9. What is illustrated is one embodiment of a means of preventing the building from rolling and the stabilizing means could comprise any retractable frame or leg. Referring to FIG. 2 another alternative is to pivot the outer segment 16 of fifth panel 5 and sixth panel 6 so that in use each segment 16 is pivoted to lie normal to the respective fifth panel 5 and sixth panel 6 to stabilize the building.

It may be desirable to provide locking means to prevent the fifth panel 5 and sixth panel 6 from collapsing inwardly when the third panel 3 and fourth panel 4 are not in a position to prevent this happening. Referring to FIGS. 1 and 5 a pair of tubes 15 are each removably attached to the exterior of fifth panel 5 and sixth panel 6.

Windows and doorways can be fitted to the side walls as required. The side walls could also be arranged to fold outwards from the building so as to provide either a ramp, or a canopy depending on the edge that is pivotally attached.

The side walls could be bisected vertically to provide two pieces that fold away from each other or oppositely to each other.

To be used the collapsible building is transported to the location where it is needed and fifth panel 5 and sixth panel 6 expanded to become linear. Third panel 3 and fourth panel 4 may then be manually placed into position or by virtue of the circular rims 9 the building can be rolled during which action third panel 3 and fourth panel 4 pivot and fall into position under gravity.

What I claim is:

1. A collapsible building which is substantially box shaped having a stabilizing means, a substantially rectangular first panel and a second panel opposite the first panel, opposite substantially rectangular third and fourth panels both of which are pivoted to the first or second panels so that they can lie substantially parallel to at least one of them when the building is collapsed and substantially normal to at least one of them when the building is erected, and opposite fifth and sixth panels which are substantially normal to at least one of the first and second panels and to the third and fourth panels and are pivotally attached to both the first and second panels, the fifth and sixth panels also having a pivotal joint so that an outer face of each panel may be collapsed onto itself in accordian fashion, each fifth and sixth panel being provided with a substantially circular rim the construction and arrangement being such that the building when erected can be rolled into location on the rims and stabilized by means of the stabilizing means when it is in its chosen position.

2. A collapsible building as claimed in claim 1 wherein the second panel is substantially rectangular and parallel to the first panel.

3. A collapsible building as claimed in claim 1 or claim 2 wherein the outer edge of the fifth and sixth panel each form the substantially circular rim.

4. A collapsible building as claimed in claim 3 wherein an outer segment of the fifth panel and sixth panel is pivoted across a line substantially parallel to the first panel, each segment being able to be pivoted to lie normal to the respective fifth and sixth panels and in use provide the stabilizing means.

5. A collapsible building as claimed in claim 1 or claim 2 wherein the fifth and sixth panel are substantially square in shape and an exterior substantially circular ring attached at the four corners of each square forms said substantially circular rim.

6. A collapsible building as claimed in claim 1 wherein the second panel is rounded in shape with its edges parallel to the first panel.

7. A collapsible building as claimed in claim 6 wherein in use the first panel forms a floor of the building, the third and fourth panels are pivoted to the first panel to form side walls of the building, and the second panel forms a roof of the building.

8. A collapsible building as claimed in claim 6 wherein the stabilizing means comprise a pair of substantially rectangular frames each pivotally attached on the fifth panel and the sixth panel, each frame pivoting along a line parallel to the first panel and which in use fold down to stabilize the building.

9. A collapsible building as claimed in claim 8 wherein there is provided locking means on each of the fifth and sixth panels to keep the fifth and sixth panels linear once the building has been erected.

10. A collapsible building as claimed in claim 9 wherein the locking means comprise a pair of tubes removably mounted on the fifth panel and on the sixth panel, each tube lying substantially normal to the line of the pivotal joint in the fifth and sixth panels.

* * * * *